US006123447A

United States Patent [19]

Schelhorn

[11] Patent Number: 6,123,447

[45] Date of Patent: Sep. 26, 2000

[54] BLENDING TROLLEY FOR FORMING VERTICAL COLUMNS OF TOBACCO IN AN INTERMEDIATE RESERVOIR

[75] Inventor: Fritz Schelhorn, Bayreuth, Germany

[73] Assignee: Brown & Williamson Tobacco Corporation, Louisville, Ky.

[21] Appl. No.: 09/186,964

[22] Filed: Nov. 5, 1998

[30] Foreign Application Priority Data

Nov. 11, 1997 [DE] Germany ..... 197 49 933

[51] Int. Cl.[7] ..... B65G 15/22; B65G 21/02

[52] U.S. Cl. ..... 366/153.2; 366/153.3; 366/186; 414/300; 198/594

[58] Field of Search ..... 366/271, 153.2, 366/153.3, 154.1, 186, 261, 341, 9; 198/371.2, 525, 594; 414/293, 300, 306

[56] References Cited

U.S. PATENT DOCUMENTS 3,811,585 5/1974 Wilding .
3,879,021 4/1975 Riley .
4,619,576 10/1986 George et al. .
5,324,158 6/1994 Shah et al. .

FOREIGN PATENT DOCUMENTS 673308 3/1939 Germany .
2024513 12/1971 Germany .
2125629 7/1976 Germany .

*Primary Examiner*—W. L. Walker
*Assistant Examiner*—A. Schwartz
*Attorney, Agent, or Firm*—Middleton & Reutlinger; John F. Salazar

[57] ABSTRACT

The invention relates to a method and a device for feeding layers of tobacco to an intermediate reservoir, including feeding a continual falling, horizontal shifting stream of tobacco to the intermediate reservoir, the falling stream of tobacco being deflected by web-type separators below, which predetermined break points form in the tobacco mass in the intermediate reservoir resulting in vertical columns of tobacco separable from each other, the columns of tobacco separating individually from the tobacco mass and dropping onto a dispensing conveyor.

21 Claims, 2 Drawing Sheets

BLENDING TROLLEY FOR FORMING VERTICAL COLUMNS OF TOBACCO IN AN INTERMEDIATE RESERVOIR

BACKGROUND OF THE INVENTION

1. Field of the Invention

The invention relates to a method and a device for feeding layers of tobacco to an intermediate reservoir.

The invention relates more particularly to a method and device for feeding layers of tobacco to a box for cut ribs and stems.

2. Description of the Related Art

Tobacco products, especially cigarettes, are typically composed of many different grades of tobacco and thus for the quality of these tobacco products a consistent fidelity in blend is substantial on the basis of the large amounts of tobacco to be processed in preparing the tobacco so that each and every cigarette contains a constantly homogenous tobacco blend.

If, for this purpose, a proportion of a certain grade of tobacco necessary for a specific blend were to be fed directly to the blending box from a silo, layers of tobacco would result in the blending box greatly differing in homogeneity to such a degree that the wanted homogeneous quality of the finished tobacco product would be unfavorably influenced.

That is why it is important in satisfying the basic requirement that the large blending boxes as known in the tobacco industry are filled with differing grades of tobacco in such a way that the various grades of tobacco are deposited by layers in such a blending box so that the lengths of the individual layers correspond to the length of the blending box.

Then, from the tobacco mass thus formed, vertical portions are removed containing tobaccos of various layers and thus various grades of tobacco to generate a homogenous blend of tobacco.

Thus, various devices have been developed, intended assure the consistent stratification in such blending boxes, see e.g. DE 20 24 513 A, U.S. Pat. No. 4,619,576 and U.S. Pat. No. 3,811,585.

A further problem associated with such a blending box is that the tobacco needs to be fed equally apportioned for further processing. For this purpose it is usually such that at the outlet end of the blending box so-called sweeper rakes are installed which acts as rotating spiked shafts and which are provided with spikes to tear the vertical tobacco portions from the face wall of the tobacco mass in the blending box. This allows this particular tobacco to be supplied for further processing. However, discharging the layers of tobacco in this way from the blending box greatly stresses the tobacco, degrading it accordingly. This applies in particular to cut tobaccos having a high moisture content which in critical bulk heights and lengthy storage periods tend to pack and clump so that discharge by means of sweeper rakes results in heavy detriment to qualify.

SUMMARY OF THE INVENTION

The invention is thus based on the object of defining a device and a method for feeding an intermediate reservoir with layers of tobacco in which the aforementioned disadvantages do not occur. More particularly, the object is to define a device and a method permitting by simply designed means the discharge of homogenous tobacco portions from the blending box without quality being detrimented in any way.

This object is achieved by a device for feeding layers of tobacco to an intermediate reservoir more particularly, to a box for cut ribs and stems, comprising a blending trolley arranged above said intermediate reservoir, said blending trolley being reciprocable in the longitudinal direction of said intermediate reservoir, said blending trolley receiving a continual feed of tobacco and a continual stream of tobacco dropping from the discharge end of said blending trolley downwardly into said intermediate reservoir, a conveyor for the further transport of the tobacco mass present in said intermediate reservoir to a dosing apparatus and web-type separators in the drop path of said tobacco between said blending trolley and said intermediate reservoir for deflecting said dropping stream of tobacco so that predetermined break points form in said tobacco mass under said separators thus forming vertical columns of tobacco separable from each other.

The object is achieved also by a method for feeding layers of tobacco to an intermediate reservoir, more particularly, a box for cut ribs and stems, including feeding a continually falling, horizontally shifting stream of tobacco to said intermediate reservoir, wherein said falling stream of tobacco is deflected by a web-type separators, below said web-type separators predetermined break points form in said tobacco mass in said intermediate reservoir, forming vertical columns of tobacco separable from each other.

There are also further embodiments of the device read from the features as set forth in the dependent claims.

The advantages achieved by the invention are based on the following mode of functioning:

The stream of tobacco falling vertically from a blending trolley in conventional ways and is deflected by web-type separators located above the intermediate reservoir, usually a blending box, so that in the vertical direction under these web-type separators, zones of lesser tobacco density materialize in all tobacco layers in the intermediate reservoir. These zones of lesser density have the effect of being "predetermined break points" in the tobacco mass so that these predetermined break points produce vertical columns of tobacco separated from each other, comprising different layers and thus grades of tobacco.

On discharge of the tobacco mass from the intermediate reservoir the first tobacco column in the discharging direction tilts away and is thus supplied as a sole, separated portion to further processing, for example a dispensing conveyor.

The tobacco mass in the intermediate reservoir is thus subjected to no mechanical agitation whatsoever so that masses of tobacco heavily compacted and tending to lump due to critical bulk heights and lengthy storage may be supplied apportioned to further processing in a gently treated manner.

Particularly in the case of cut rib and stem tobacco processing needs to be done in the presence of a high moisture content, this being the reason why the invention is especially suitable for the application of cut rib and stem tobacco blending bins or silos, also hereinafter termed a "shag box".

Expediently the web-type separators are formed by two strips connected to each other and being A-shaped or steep roof as viewed from the side. The horizontal basic surface area of the roof should have a width of approximately 30 to 200 mm, more particularly 80 to 160 mm, while the height should be in the range of 30 to 120 mm, more particularly 40 to 100 mm. These dimensions of the roof-shaped separators ensure that, on the one hand, predetermined break points materialize of sufficient width, thus making for satisfactory separation of the individual tobacco columns and, on the other, enabling the tobacco to slide downwards on the side surface areas of the separators without sticking thereto.

Experience has shown it to be beneficial if the web-type separators are spaced away from each other by 30 to 60 cm, more particularly 40 to 50 cm, since in this way homogenous tobacco portions, i.e. the aforementioned tobacco columns, may be formed for further processing.

In one preferred embodiment the underside of the outlet end of the blending trolley mounts a blade for sweeping tobacco from the upper surface areas of the web-type separators to prevent tobacco collecting and thus encrusting. The blade may consist of a metal plate which runs past the top edge of the web-type separators slightly spaced away therefrom, or of a deformable material which strokes the surface areas of the web-type separators, thereby sweeping off the tabacco.

BRIEF DESCRIPTION OF THE DRAWINGS

The invention will now be discussed in more detail by way of an example embodiment with reference to the accompanying schematic drawings in which.

DESCRIPTION OF THE PREFERRED EMBODIMENTS

Figure 1:
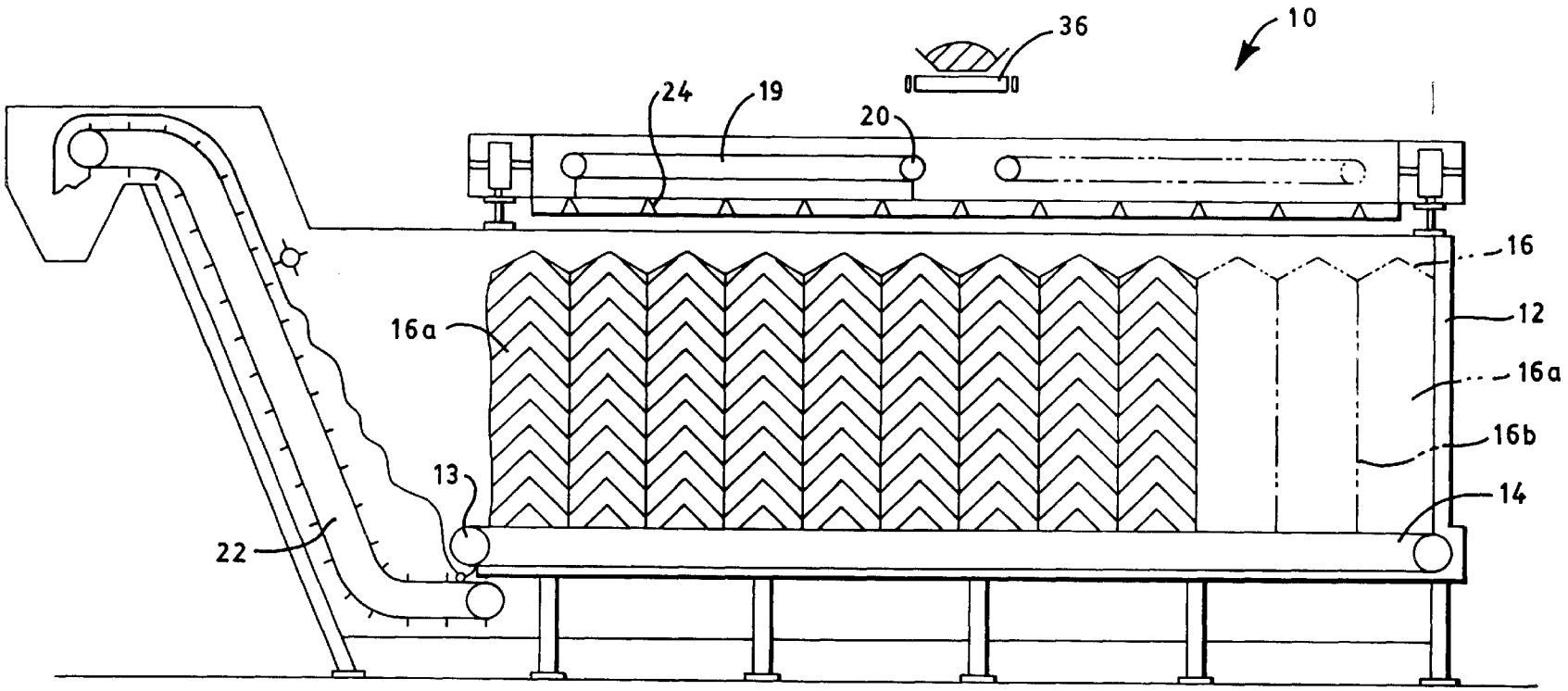
FIG. 1 is a side view of a device for feeding a box for cut ribs and stems with layers of tobacco and FIG. 2 is a perspective view of the horizontal shiftable blending trolley with the separating webs as seen from above.

Referring now to FIG. 1 there is illustrated a blending plant, identified in general by the reference numeral 10, comprising a box 12 for cut ribs and stems which is usually approximately cuboidal and open at the top, the bottom of which is formed by a horizontal conveyor belt 14 so that the horizontal layers of tobacco located in the box 12 for cut ribs and stems, as indicated schematically, are transported out of the open end of the box 12, shown on the left in FIG. 1, and brought to a more or less vertical dispensing conveyor 22 which feeds the cut rib and stem tobacco to further processing.

The box 12 receives the cut ribs and stem tobacco from above by a blending trolley 19 comprising a conveyor belt 18 mounted on rollers 26 in a horizontal frame 28 having rails so that the conveyor belt 18 may be shuttled or reciprocated horizontally in the frame 28. Arranged above the conveyor belt 18, as viewed in the transporting direction of the tobacco, are two rim slats 30 preventing the tobacco from dropping off the side of the conveyor belt 18.

At its two longitudinal ends the frame 28 comprises further rollers 32 running on cross rails 34 so that the complete frame 28 may be shifted at right angles to the direction of movement of the blending trolley 19 and thus shuttled or reciprocated over the width of the box 12 for cut ribs and stems, as a result of which a single, relatively narrow blending trolley is able to feed the total width of the box 12 for cut ribs and stems.

The blending trolley 19 is fed with cut rib and stem tobacco from above by a further conveyor belt 36, indicated schematically in FIG. 1, this conveyor belt being synchronized to the horizontal movement of the blending trolley 19. For this purpose the conveyor belt 36 is, as a rule, included in the movement of the blending trolley 19 horizontally so that continuous feeding of the blending trolley 19 with cut rib and stem tobacco is assured.

From the discharge end 20 of the blending trolley 19 the cut rib and stem tobacco is deposited by free fall into the box 12 for cut ribs and stems where it is stacked in layers, as indicated schematically by the zig-zag lines in FIG. 1, and materialize from the horizontal movement of the blending trolley 19. Each layer contains a specific grade of tobacco furnished by the aforementioned synchronization of the conveyor belt 36 so that it is not until all layers are present that the desired tobacco blend materializes.

The tobacco mass 16 in the box 12 for cut ribs and stems is discharged to the left as shown in the illustration of FIG. 1 and tilts at the discharge end 12 of the conveyor belt 14 to the left to drop onto a near vertical dispensing conveyor 22.

Figure 2:
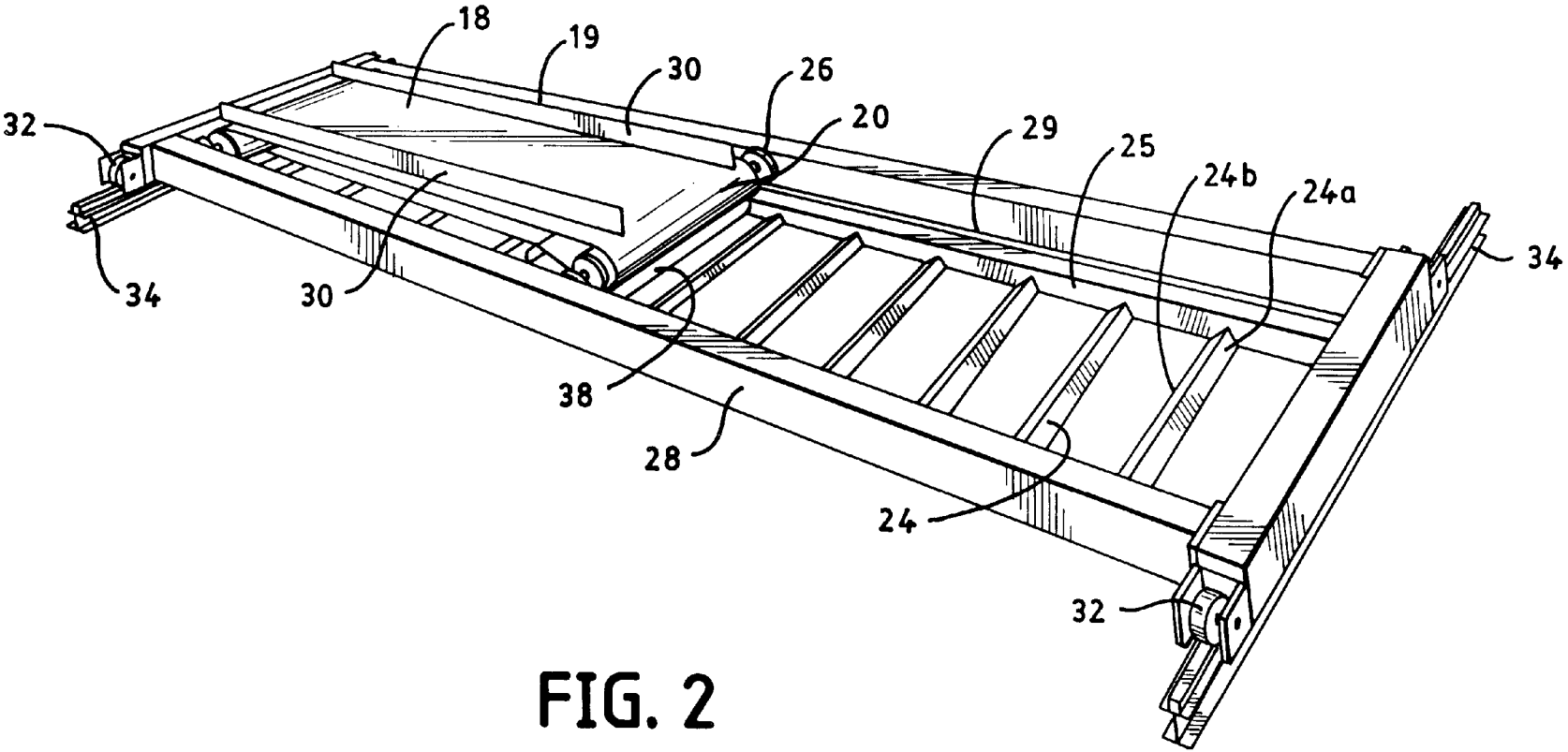

Referring now to FIG. 2 in particular it is evident that horizontal separating webs 24 are provided in the frame 28, these webs being formed by approximately roof-shaped sections of sheet metal and extending at right angles to the longitudinal edges of the frame 28 over the full frame opening (see FIG. 2).

When the frame already exists, a ladder-type component having longitudinal edges 25 and webs 24 may be produced as a single unit which is then inserted in the frame 28.

The falling stream of tobacco continually discharged from the discharge end 20 of the blending trolley is "intercepted" by the separating webs 24 so that the stream of tobacco is deflected somewhat by these webs 24, so that the portions of the box 12 for cut ribs and stems located vertically directly below the webs 24 are not directly fed with tobacco.

By slightly shifting the tobacco horizontally as it impacts at the bottom, a compact tobacco mass 16 forms. This is less dense in the regions under the separating webs 24, however, so that the tobacco mass 16 consists of vertical tobacco columns 16*a* which are separated from each other by "predetermined break points" 16*b*, namely regions of less tobacco density below the webs 24.

When the tobacco mass 16 is moved out of the box 12 for cut ribs and stems to the left as shown in FIG. 1, and comes up to the discharge end 13 of the conveyor belt 14 at which the tobacco 16 is tilted to the left and then finally drops off, then the first tobacco column 16*a* separates at these "predetermined break points" 16*b* from the remainder of the tobacco mass and is deposited as a uniform homogenous portion of tobacco on the dispensing conveyor 22 containing tobaccos from all horizontal layers.

Referring now to FIG. 2 it is evident that a blade 38 is applied to the blending trolley 19 below its discharge end 20, this blade sweeping the remaining tobacco from the top edges of the separating webs 24. This blade 38 may be formed by a sweeper plate of sheet metal, this necessitating, however, that the lower edge of the blade 38 is set highly exactly to the upper edge of the webs 24 so that a spacing of approximately 1 mm at the most exists between these two edges to ensure that the tobacco is swept off safely and reliably.

As an alternative to the above arrangements the blade 38 may be formed of a deformable material which strokes the surface of the separating webs 24 to thereby sweep off the remaining tobacco.

The separating webs have a spacing of approximately 30 to 60 cm from each other so that the tobacco columns 16*a* have a corresponding width and the associated homogenous amount of tobacco is deposited on the dispensing conveyor 22.

The separating webs 24 are roof-shaped as viewed from the side, i.e. in the form of an isosceles triangle having a horizontal open underside approximately 120 mm wide. The height of the triangle amounts to approximately 100 mm. With these dimensions the side surface areas of the separating webs 24 form an angle to each other such that the tobacco is able to slide downwards on these surface areas with no problem.

What is claimed is:

1. A device for feeding layers of tobacco to an intermediate reservoir, comprising:

a blending box having first and second support end rails resting upon said box;

a horizontal frame having first and second side rails and wherein said frame is resting upon said first and second support end rails;

a plurality of horizontal separating webs inserted in said frame extending between said first and second side rails of said frame, said webs spaced between said first and second support end rails;

said horizontal frame being movable on said first and second support end rails;

a blending trolley positioned above said webs and movable along said first and second side rails of said horizonal frame and having a movable belt thereon; and, a feeding conveyor positioned above said blending trolley.

2. The device as set forth in claim 1, wherein said webs are formed by two strips connected to each other and have a cross section formed as an A-shaped roof.

3. The device as set forth in claim 2, wherein said webs have a width of approximately 30 to 200 mm, and a height in the range of 30 to 120 mm.

4. The device as set forth in claim 3, wherein said webs have a width of 80 to 160 mm.

5. The device as set forth in claim 3, wherein said webs have a height of 40 to 100 mm.

6. The device of claim 1 wherein said plurality of horizontal separating webs of said frame are perpendicular to and extend between said first and second side rail.

7. The device of claim 6 wherein said of webs are substantially triangular in shape, having a flat base and pointed top portion, said pointed top portion being adjacent to and directed towards said blending trolley.

8. The device of claim 7 further comprising a sweeper blade, said sweeper blade directed downwards from said device towards said pointed top portion of said plurality webs.

9. The device as set forth in claim 1, wherein said webs have a spacing of 30 to 60 cm from each other.

10. The device as set forth in claim 9, wherein said webs have a spacing of 40 to 50 cm from each other.

11. The device as set forth in claim 1, wherein said blending device comprises a discharge end with a blade for sweeping tobacco from said webs.

12. The device as set forth in claim 11, wherein said blade consists of sheet metal or of a deformable material.

13. The device as set forth in claim 1, wherein said blending device comprises rollers running on said side rails in said frame.

14. The device as set forth in claim 8, wherein said frame comprises rollers running on said end rails at right angles to the direction of movement of said blending trolley.

15. The device of claim 1 further comprising:

a conveyor belt within said blending box, said conveyor belt having a discharge end;

a dispensing conveyor adjacent said discharge end of said conveyor belt within said blending box.

16. The device of claim 15 wherein said dispensing conveyor has a plurality of outwardly extending spikes thereon, said dispensing conveyor being substantially horizontal in orientation.

17. The device of claim 1 wherein said webs of said support frame form blended tobacco columns in said box below said trolley, each of said webs defining vertical column break point for each of said tobacco columns.

18. The device of claim 17 further comprising:

rollers affixed to said blending device and movable on said first and second side rails.

and rollers supporting said frame and rotatably affixed to said first and second end rail, said rollers supporting said frame movable on said first and second support end rail.

19. The device as set forth in claim 1, wherein said webs consist of sheet metal.

20. The device as set forth in claim 1, wherein said blending trolley comprises a conveyor belt having rim slats.

21. The device of claim 1, said feeding conveyor synchronized with movement of said trolley.

* * * * *

UNITED STATES PATENT AND TRADEMARK OFFICE

CERTIFICATE OF CORRECTION

PATENT NO. : 6,123,447

DATED : September 26, 2000

INVENTOR(S) : Schelhorn

It is certified that error appears in the above-identified patent and that said Letters Patent is hereby corrected as shown below:

Claim 7, line 39, after "said", delete - - of- - ;
Claim 7, line 42, before "pointed", insert - - a - - ;
Claim 8, line 45, after "said", delete - - plurality - - ;
Claim 16, lines 25 & 26, change "horizontal" to --vertical--;
Claim 17, line 28, change"support" to - - horizontal--;
Claim 17, line 29, after "defining" insert - - a - - ;
Claim 18, line 36, change "rail" to --rails--;
Claim 18, line 38, change "rail" to --rails--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*